US009289998B2

(12) United States Patent
Aoki

(10) Patent No.: US 9,289,998 B2
(45) Date of Patent: Mar. 22, 2016

(54) RECORDING APPARATUS AND MULTI-FUNCTION PRINTER

(71) Applicant: SEIKO EPSON CORPORATION, Tokyo (JP)

(72) Inventor: Yoshisada Aoki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/566,481

(22) Filed: Dec. 10, 2014

(65) Prior Publication Data

US 2015/0165772 A1 Jun. 18, 2015

(30) Foreign Application Priority Data

Dec. 18, 2013 (JP) ..... 2013-261042

(51) Int. Cl.
*B41J 2/175* (2006.01)
*B41J 29/02* (2006.01)
*B41J 29/13* (2006.01)

(52) U.S. Cl.
CPC ..... *B41J 2/175* (2013.01); *B41J 2/17509* (2013.01); *B41J 29/02* (2013.01); *B41J 29/13* (2013.01)

(58) Field of Classification Search
USPC ..... 347/2, 85, 86
See application file for complete search history.

(56) References Cited

U.S. PATENT DOCUMENTS

| | | | | |
|---|---|---|---|---|
| 6,158,855 | A * | 12/2000 | Saikawa | 347/93 |
| 6,164,766 | A * | 12/2000 | Erickson | 347/85 |
| 6,843,558 | B2 * | 1/2005 | Seino | 347/85 |
| 7,008,051 | B2 | 3/2006 | Akermalm | |
| 8,870,349 | B2 * | 10/2014 | Koizumi | 347/50 |
| 2012/0038719 | A1 * | 2/2012 | Shimizu et al. | 347/86 |

FOREIGN PATENT DOCUMENTS

JP 2013-121659 6/2013

* cited by examiner

*Primary Examiner* — Anh T. N. Vo
(74) *Attorney, Agent, or Firm* — Workman Nydegger

(57) ABSTRACT

A recording device includes a main body case that is arranged inside a recording head which ejects ink to paper, and an ink storing device that stores the ink to be supplied to the recording head and is attached to the outer side surface of the main body case through a screw member. When upward external force is added from the ink storing device, the main body case includes a reception section which can accept the external force.

7 Claims, 16 Drawing Sheets

RECORDING APPARATUS AND MULTI-FUNCTION PRINTER

BACKGROUND

1. Technical Field

The present invention relates to, for example, a recording device, such as an ink jet type printer, and a multi-function printer which includes the recording device.

2. Related Art

In the related art, an ink jet type printer which performs printing (recording) by ejecting ink from a recording head to a medium, such as paper, has been known as one kind of recording device. When a relatively large amount of printing is performed in such a printer, it is necessary to successively stably supply ink to the recording head. Therefore, this kind of printer is configured to include an external ink tank (liquid storing device), which stores a large capacity of liquid container, on the outside of the device main body of the printer, and is configured to supply ink to the recording head which is arranged in the device main body through ink supply tubes from the external ink tank (for example, refer to JP-A-2013-121659).

However, in the above-described printer, there is a case in which the external ink tank is attached to the outer side surface of the device main body in the printer using screws or the like in consideration of convenience when the printer is carried. Further, when the printer is carried, a user generally lifts up the printer using the external ink tank as a handgrip. Therefore, stress is concentrated on the attachment section of the external ink tank for the device main body of the printer, with the result that screws or the like, which are components of the attachment section, are bent, and thus there is a problem in that the attachment state of the external ink tank for the device main body is deteriorated.

Meanwhile, the problem is not limited to the ink jet type printer and is generally common to a recording device that includes a liquid storing device, in which liquid to be supplied to a recording head of a device main body is stored, on the outside of the device main body and that is attached with the liquid storing device on the side surface of the device main body, and a multi-function printer including the recording device.

SUMMARY

An advantage of some aspects of the invention is to provide a recording device which can prevent the attachment state of a liquid storing device for a device main body from being deteriorated when the recording device is lifted up using the liquid storing device which is attached to the side surface of the device main body as a handgrip, and a multi-function printer including the recording device.

Hereinafter, means to solve the problem and advantages will be described.

According to an aspect of the invention, there is provided a recording device including: a recording head that ejects liquid to a medium; a device main body that is arranged with the recording head inside; and a liquid storing device that is configured to store the liquid to be supplied to the recording head and is attached to an outer side surface of the device main body through an attachment section. The device main body includes a reception section which can accept external force when upward external force is added from the liquid storing device.

According to the aspect, when the user lifts up the recording device using the liquid storing device as a handgrip, upward external force is added to the device main body of the recording device from the side of the liquid storing device, and the external force is accepted by the reception section of the device main body. Therefore, it is possible to avoid stress concentrating on the attachment section of the liquid storing device for the device main body. Accordingly, when the recording device, which is attached to the side surface of the device main body, is lifted up using the liquid storing device as a handgrip, it is possible to prevent the attachment state of the liquid storing device for the device main body from being deteriorated.

In the recording device, it is preferable that the reception section include a downward surface which expands in a direction perpendicular to a vertical direction and faces a gravity direction.

According to the aspect, the upward external force from the liquid storing device is accepted in such a way that the downward surface, which forms the reception section, comes into contact with the liquid storing device from above. Accordingly, it is possible to easily avoid stress concentrating on the attachment section of the liquid storing device for the device main body with a simple configuration.

In the recording device, it is preferable that the downward surface have a surface shape which inclines toward a side approaching the device main body from a side separated from the device main body in the direction perpendicular to the vertical direction, and that the liquid storing device be attached to the outer side surface of the device main body in a displaceable state, and is configured to include a upward surface which can slide on the downward surface.

According to the aspect, when a user lifts up the recording device using the liquid storing device as a handgrip, the liquid storing device is displaced on the side of the device main body while the upward surface thereof slides on the downward surface of the reception section of the device main body in the oblique upper direction, and thus it is possible to excellently maintain the attachment state for the device main body.

In the recording device, it is preferable that a reinforcement member, which comes into contact with the reception section with rigidity compared to a portion of the liquid storing device which faces the reception section, be interposed between the reception section of the device main body and the liquid storing device.

According to the aspect, it is possible to reinforce the attachment state of the liquid storing device for the device main body by interposing the reinforcement member.

In the recording device, it is preferable that the reception section include any of a protrusion which has a shape protruding in the direction perpendicular to the vertical direction, a depression which has a shape fitting to the protrusion, and an eave section which has a shape projecting in the direction perpendicular to the vertical direction.

According to the aspect, any of the protrusion which has a shape protruding in the direction perpendicular to the vertical direction, the depression which has a shape fitting to the protrusion, and the eave section which has a shape projecting in the direction perpendicular to the vertical direction is formed on the side surface of the device main body. Therefore, it is possible to easily form the reception section.

Further, according to another aspect of the invention, there is provided a multi-function printer including: a recording device that performs a recording operation by ejecting liquid; and a reading device that reads information recorded on a manuscript. The recording device includes: a recording head that ejects liquid to a medium; a device main body that is arranged with the recording head inside; and a liquid storing device that is configured to store the liquid to be supplied to the recording head and is attached to an outer side surface of the device main body through an attachment section. The device main body includes a reception section which can accept external force when upward external force is added from the liquid storing device, the reading device is arranged in an upper portion of the device main body of the recording device, and the reception section is configured in such a way that a part of the reading device protrudes from the device main body in a direction perpendicular to a vertical direction.

According to the aspect, it is possible to accomplish the same effect in the multi-function printer as in a case of the recording device.

BRIEF DESCRIPTION OF THE DRAWINGS

The invention will be described with reference to the accompanying drawings, wherein like numbers reference like elements.

FIG. 10A is a perspective diagram illustrating a state in which an opening/closing cover is closed, and FIG. 10B is a perspective diagram illustrating a state in which an opening/closing cover is open.

FIG. 16A is a cross-sectional diagram illustrating a state before the recording device is raised, and FIG. 16B is a cross-sectional diagram illustrating a state in which the recording device is raised using the ink storing device as a handgrip.

DESCRIPTION OF EXEMPLARY EMBODIMENTS

Hereinafter, a recording device according an embodiment will be described with reference to the accompanying drawings. Meanwhile, the recording device according to the embodiment is, for example, an ink jet type printer which performs recording (printing) by ejecting ink, which is an example of liquid, to a medium such as paper.

Figure 1:
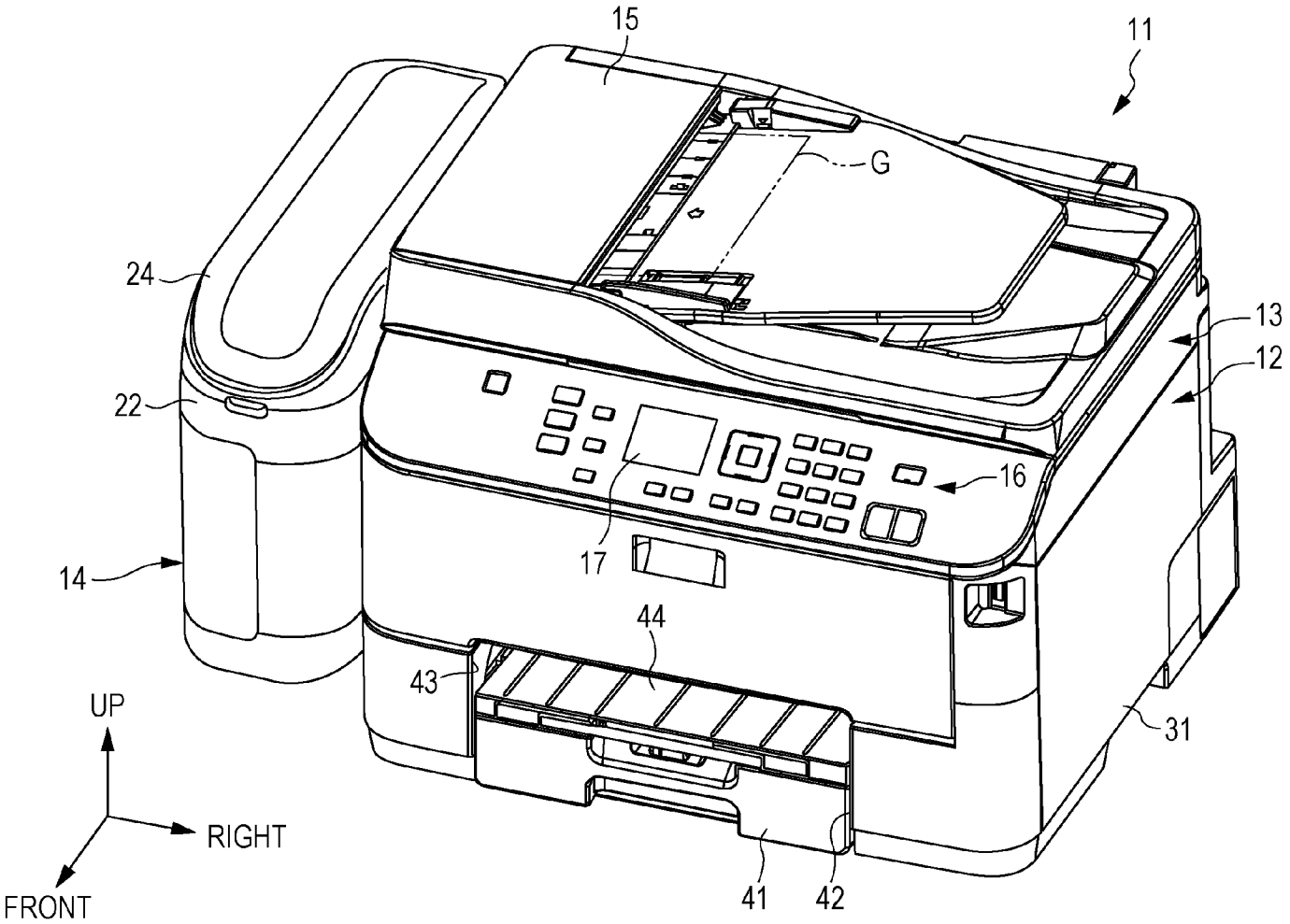
FIG. 1 is a perspective diagram illustrating the appearance of a multi-function printer which includes a recording device according to an embodiment.

As shown in FIG. 1, a multi-function printer 11 includes a recording device 12 that performs a recording operation by ejecting ink, a reading device 13 that reads information which is recorded on a manuscript G, an ink storing device (liquid storing device) 14 that stores ink to be supplied to the recording device 12, and an automatic manuscript feeding section 15 that sequentially feeds a plurality of laminated manuscripts G to the reading device 13. The reading device 13 is arranged above the recording device 12, and the automatic manuscript feeding section 15 is arranged above the reading device 13. In addition, the front surface of the multi-function printer 11 is provided with an operation section 16 that is operated when a user inputs information to the multi-function printer 11, and a display section 17 on which various types of information of the multi-function printer 11 are displayed. Meanwhile, the display section 17 is, for example, a liquid crystal display or the like.

Figure 2:
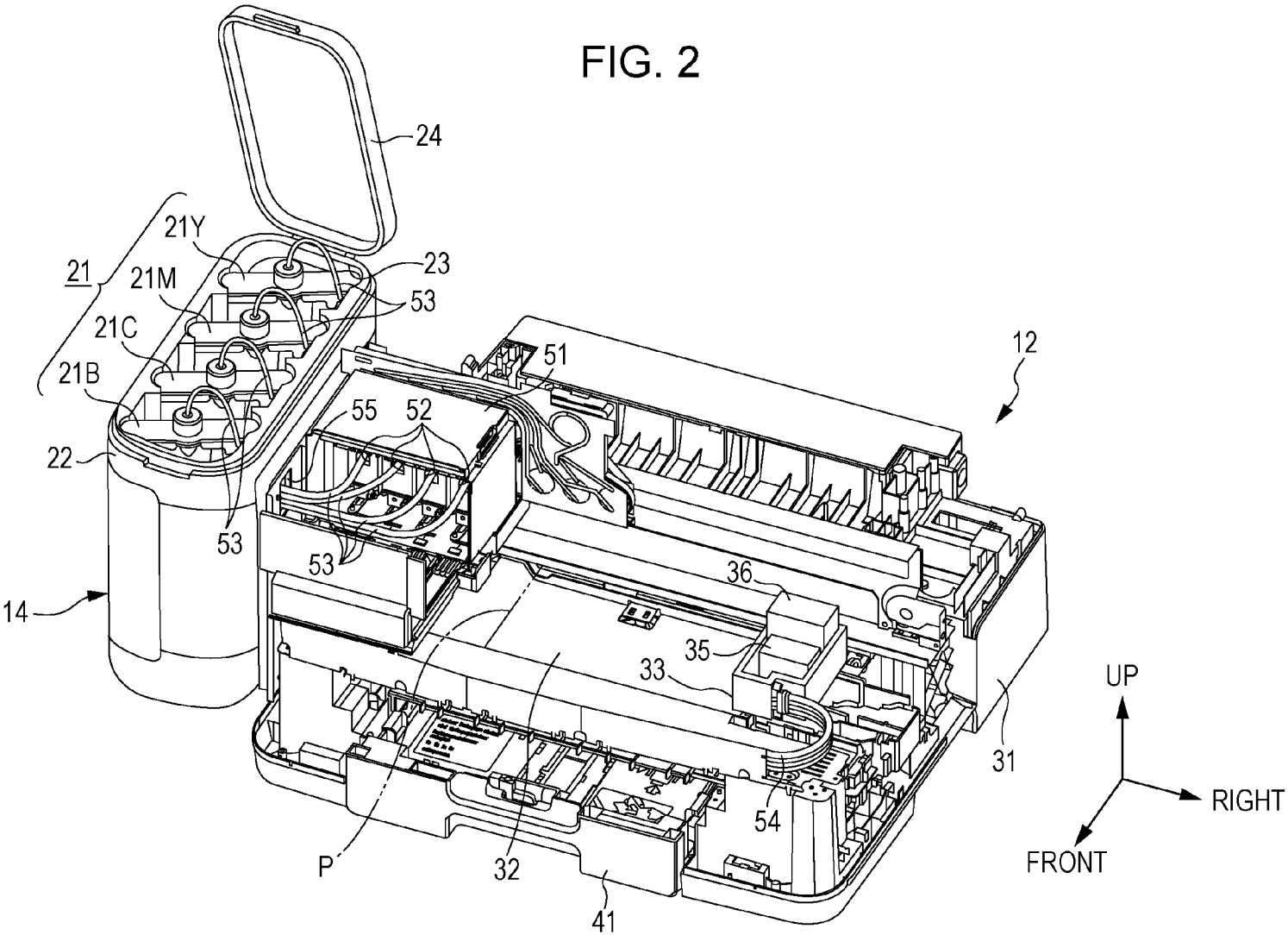
FIG. 2 is a perspective diagram illustrating the internal configuration of the recording device.

As shown in FIGS. 1 and 2, the ink storing device 14 is arranged on one side (left side) in the right and left direction of the recording device 12. In addition, as shown in FIG. 2, the ink storing device 14 includes an ink storing body 21 that includes a plurality of (four in the embodiment) high capacity bags, and a resin external case 22 that stores each ink storing body 21 and is attached to the outer side surface of the recording device 12. The external case 22 has a bottomed-rectangular box shape, which is long in the front and rear direction and which includes an opening 23 for storing each ink storing body 21 on an upper end, and includes a lid 24 which opens and closes the opening 23.

Four ink storing bodies 21 are arranged along the front and rear directions inside the external case 22. That is, from a front side to a rear side, an ink storing body 21B which stores black ink, an ink storing body 21C which stores cyan ink, an ink storing body 21M which stores magenta ink, and an ink storing body 21Y which stores yellow ink are stored. In addition, the external case 22 is detachably attached to the left side surface of the recording device 12 such that the height thereof is equal to the height of the reading device 13.

As shown in FIGS. 1 and 2, the recording device 12 includes a main body case (device main body) 31 that has approximately a rectangular shape which is long in the right and left direction. The central section of the main body case 31 is provided with a support base 32 that supports paper P which is an example of a medium. In addition, the upper side of the support base 32 is provided with a carriage 33 which is capable of making reciprocating motions in the right and left direction which is the main scanning direction.

A recording head 35, which is formed with nozzles (not shown in the drawing) for ejecting ink, and a small amount of auxiliary tank 36, which can store ink less than the ink storing body 21, are supported in the carriage 33. The recording head 35 is supported by the carriage 33 such that the nozzles face the support base 32. In addition, a single auxiliary tank 36 is provided to correspond to the high capacity ink storing body 21B, which stores the black ink, and the auxiliary tank 36 stores the black ink. Further, the recording head 35 performs recording (printing) on the paper P by ejecting ink to the paper P, which is transported on the support base 32, when the carriage 33 moves in the horizontal direction.

As shown in FIG. 1, on the bottom side of the recording device 12, a paper feeding cassette 41, which is capable of storing a plurality of pieces of paper P in a laminated state, is detachably attached to the main body case 31 through a paper feeding cassette attachment port 42 which is provided in the lower central section of the front surface of the main body case 31. The paper P in the paper feeding cassette 41 is reversed one by one and fed to the support base 32 from the rear side by a paper feed mechanism (not shown in the drawing). Further, completely recorded paper P on the support base 32 is sequentially delivered from the paper delivery port 43 which is formed in an upper side area than the paper feeding cassette 41 in the paper feeding cassette attachment port 42. Meanwhile, a paper delivery tray 44, which supports the paper P sequentially delivered from the paper delivery port 43, is provided to be extensible in the front and rear directions on the upper side of the paper feeding cassette 41.

As shown in FIG. 2, in the left end section of the main body case 31, the recording device 12 includes a holder case 51 which has a rectangular box shape, the front side of which is open, and connection sections 52 which include a plurality of (four in the embodiment) ink supply needles or the like provided on the bottom wall (rear wall) in the holder case 51 and arranged in the horizontal direction.

The tip section of each of the connection sections 52 is connected to one end of each connection tube 53 which includes another end connected to the ink storing body 21, and the base end section of each of the connection sections 52 is connected to one end of the recording head 35 which includes another end connected to each supply tubes 54. Here, the supply tubes 54 and the connection tubes 53 are formed of a material which has flexibility. In addition, each of the supply tubes 54 is provided with a pump (not shown in the drawing) which feeds ink to the side of the ink recording head 35. Therefore, each ink, which is supplied to each of the connection sections 52 from each ink storing body 21 of the ink storing device 14 through each of the connection tubes 53, is supplied to the recording head 35 through each of the supply tubes 54. Meanwhile, as shown in FIG. 2, a connecting hole 55, which allows the communication between the inside and outside of the main body case 31, is formed on the left side wall of the main body case 31. Each of the connection tubes 53 connects the ink storing body 21 to the connection section 52 in a state in which the connection tubes 53 are inserted into the connecting hole 55.

Figure 3:
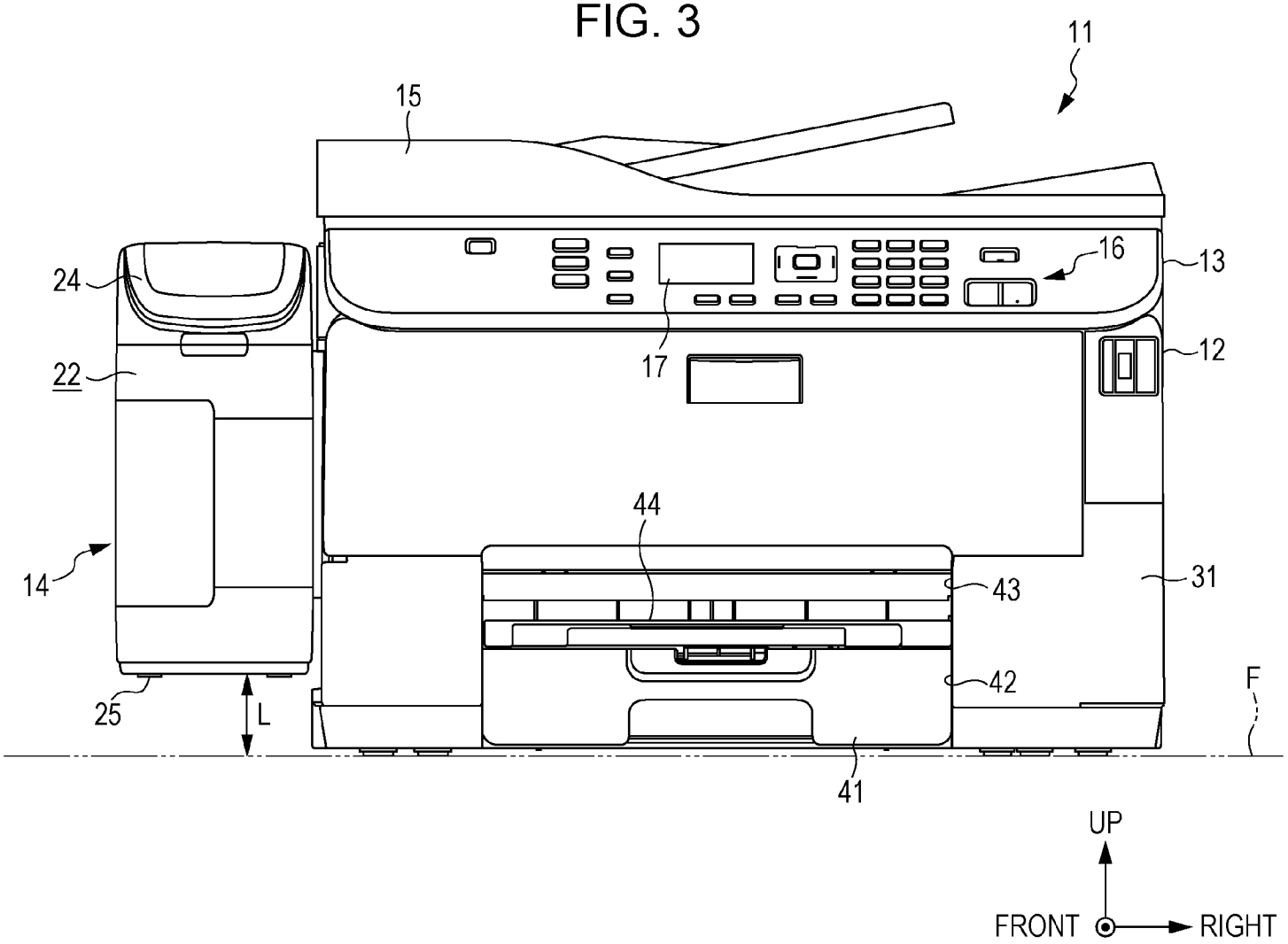
FIG. 3 is a front view illustrating the multi-function printer which includes the recording device.

In addition, as shown in FIG. 3, the multi-function printer 11 is used in such a way that the recording device 12 which is located on the bottom side of the reading device 13 is installed on the installation surface F of a table or the like. Further, at this time, the external case 22 of the ink storing device 14, which is attached to the side surface (left side surface in FIG. 3) of the main body case 31 of the recording device 12, is attached in a state in which the bottom surface 25 thereof is raised from the installation surface F by a predetermined distance L. In this case, it is preferable that the distance L between the bottom surface 25 of the external case 22 and installation surface F be a distance, which forms a gap allowing a user to put fingers therein, when the user lifts up the recording device 12 (multi-function printer 11) using the external case 22 as a handgrip.

Subsequently, a structure in which the external case 22 of the ink storing device 14 is attached to the main body case 31 of the recording device 12 will be described.

Figure 4:
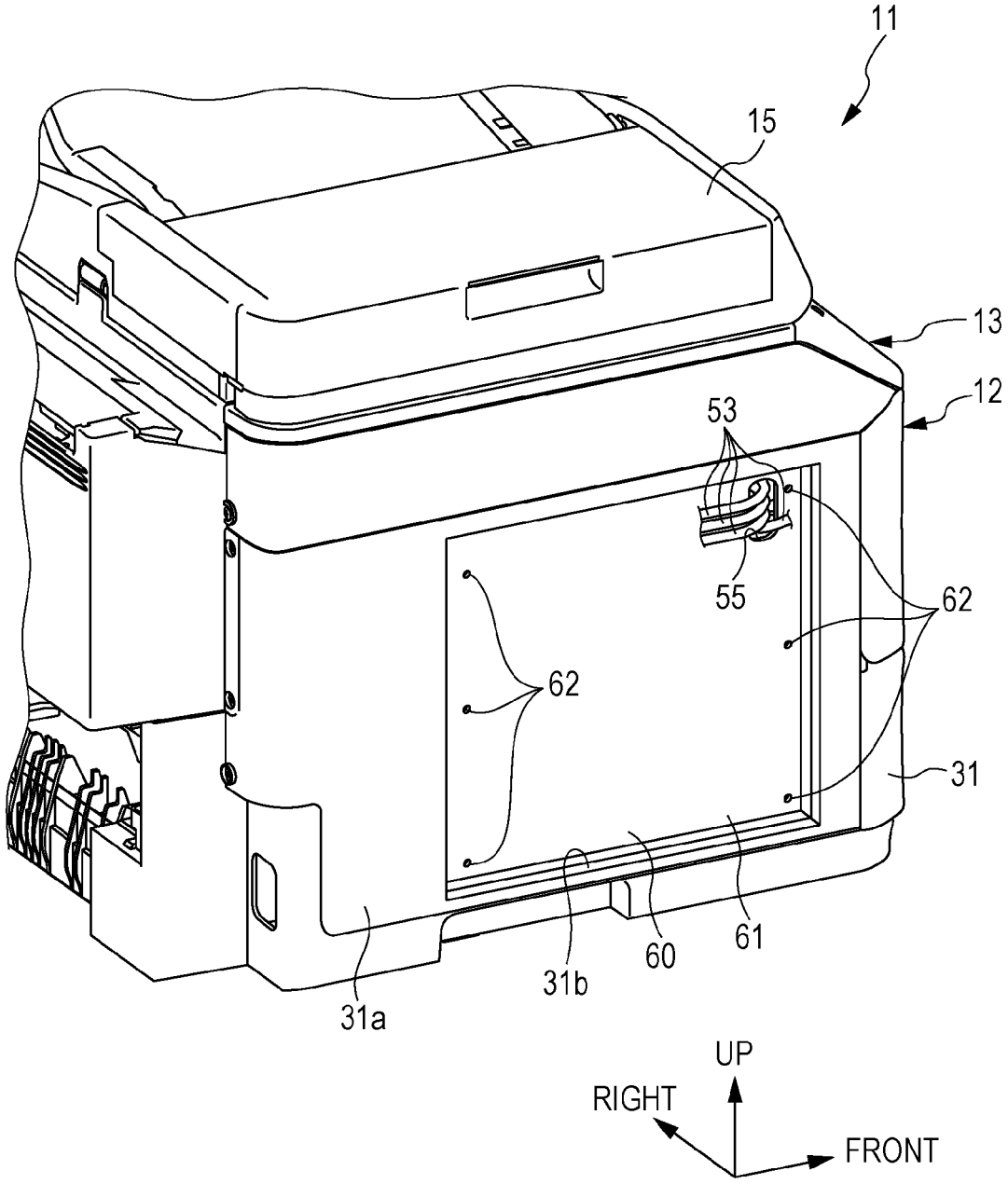
FIG. 4 is a perspective diagram illustrating the main body case of the recording device viewed from the left rear side.

As shown in FIG. 4, a rectangular opening 31*b* is formed in the side wall (in this case, left side wall) 31*a* of the main body case 31 of the recording device 12. Further, a metal frame member 61, which includes a rectangular depression 60 corresponding to the opening 31*b*, is fixed to cover the opening 31*b* from the inner side of the main body case 31 on the inner surface of the side wall 31*a* of the main body case 31. That is, the side wall 31*a* of the main body case 31 is formed of a resin material having more inferior rigidity than the frame member 61, and the metal frame member 61 has a function to reinforce the side wall 31*a* of the resin main body case 31.

Meanwhile, in the corner edge position on the upper front side of the frame member 61, a connecting hole 55, which causes the connection tubes 53 for connecting the ink storing body 21 to the connection section 52 to be inserted, is formed to penetrate through. Further, attachment holes 62 are formed at a plurality of spots (six spots in FIG. 4) in the depression 60 of the frame member 61. That is, in this case, the attachment holes 62 are screw holes which include female screws formed on the inner circumferential surface thereof.

Figure 5:
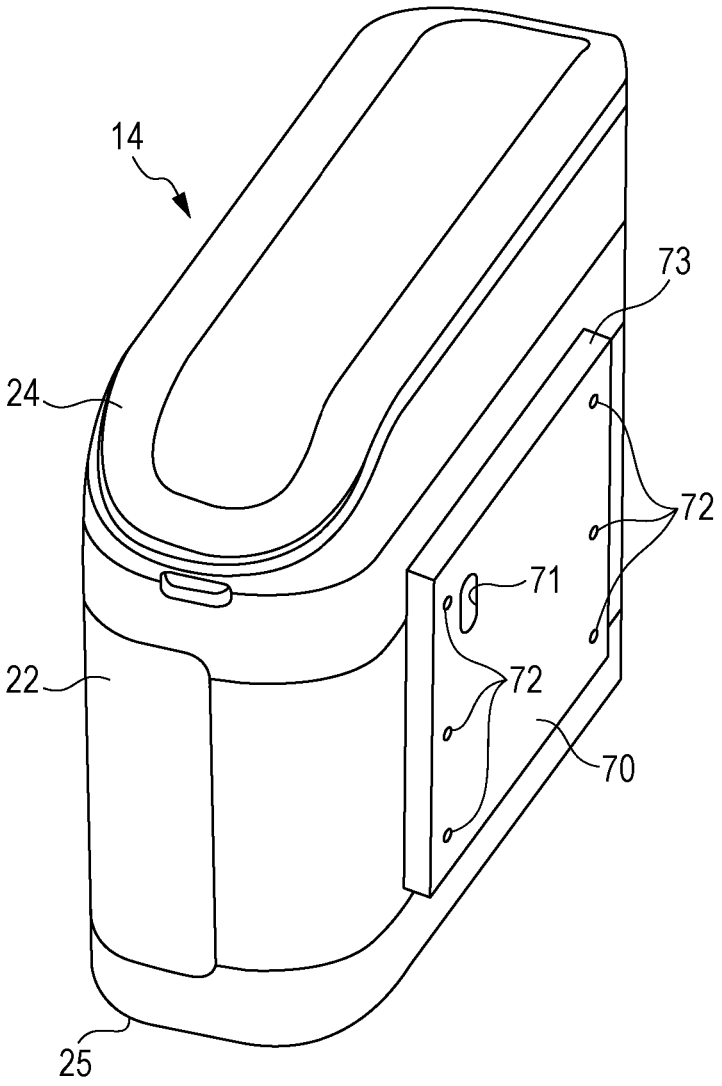
FIG. 5 is a perspective diagram illustrating an ink storing device in the same recording device.

In contrast, as shown in FIG. 5, on the side surface which is the side of the main body case 31 when the external case 22 of the ink storing device 14 is attached to the main body case 31, a protrusion 70 which has a shape capable of being fit to the depression 60 included in the frame member 61 of the main body case 31 is formed to project in the direction perpendicular to the vertical direction in a state in which the external case 22 is attached to the main body case 31. Meanwhile, in the position of the protrusion 70, which matches with the connecting hole 55 when the external case 22 of the ink storing device 14 is attached to the main body case 31, the connecting hole 71 which causes the connection tubes 53 to be inserted is formed to penetrate through. In addition, the attachment holes 72 are formed at a plurality of spots (six spots in FIG. 5) which respectively correspond to the attachment holes 62 when the protrusion 70 is attached to the main body case 31. That is, in this case, the attachment holes 72 are also the screw holes which include female screws formed on the inner circumferential surface thereof. Further, in this case, the end surface of the protrusion 70, which faces an upper side when being attached to the main body case 31, forms an upward surface 73 which expands in the direction perpendicular to the vertical direction and faces the antigravity direction.

Figure 6:
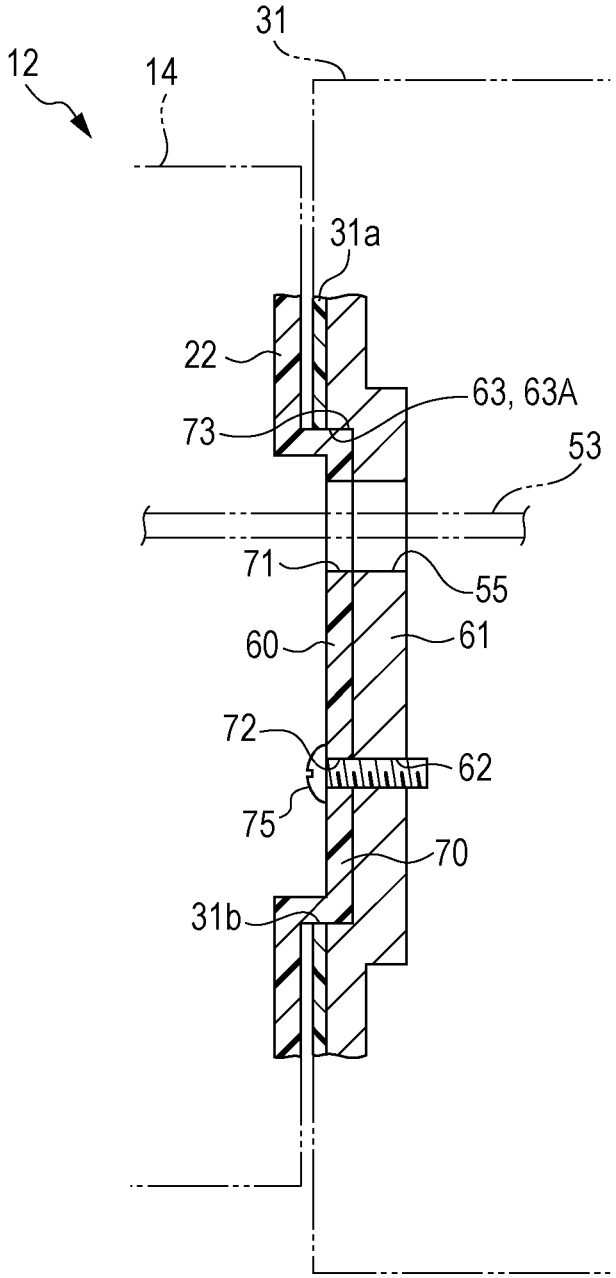
FIG. 6 is a cross-sectional diagram illustrating the attachment state of the main body case of the same ink storing device.

As shown in FIG. 6, the external case 22 of the ink storing device 14 is attached to the side surface of the main body case 31 of the recording device 12 in a state in which the protrusion 70 is fitted to the depression 60 on the side of the main body case 31. Further, in the fitting state, the connecting hole 55 matches with the connecting hole 71, and the connection tubes 53 are inserted into both the continuous connecting holes 55 and 71. In addition, the attachment holes 62 match with the attachment holes 72, and the screw member 75 which forms the attachment section is screwed into both the continuous attachment holes 62 and 72. Further, in the inner side surface of the depression 60 on the side of the main body case 31, a portion, which faces the upward surface 73 of the protrusion 70 on the side of the ink storing device 14 in the vertical direction, forms the downward surface 63 which expands in the direction perpendicular to the vertical direction and faces the gravity direction.

Subsequently, an operation performed by the recording device 12, which is configured as described above, according to the embodiment will be described below focusing on an action when the user lifts up the recording device 12 (multi-function printer 11).

Further, when the user lifts up, for example, the recording device 12 (multi-function printer 11) which is in a state shown in FIG. 3, the user usually positions fingers on a lower portion of the right side surface of the recording device 12 and positions other fingers on the side of the bottom surface 25 of the external case 22 of the ink storing device 14. That is, the user lifts up the recording device 12 using the external case 22 of the ink storing device 14 as a handgrip. Therefore, when the recording device is lifted up, the external case 22 which is attached to the main body case 31 receives external force toward the upper side through the screw member (attachment section) 75. Further, the upward external force, which is added to the external case 22, is subsequently applied to the screw member 75 through the attachment holes 72 of the external case 22.

In addition, as shown in FIG. 6, here, in the protrusion 70 on the side of the external case 22 and the depression 60 on the side of the main body case 31 at this time, the upward surface 73 and the downward surface 63, which face each other in the vertical direction, come into contact with each other. Therefore, upward external force from the side of the ink storing device 14 is added to the side of the main body case 31 through the contact with the upward surface 73 and the downward surface 63. Further, the upward external force is accepted by the downward surface 63 included in the depression 60 on the side of the main body case 31. At this point, the downward surface 63, which is a part of the inner surface of the depression 60 of the side of the main body case 31, functions as a reception section 63A which can accept the external force when the external force toward the upper side is added from the side of the ink storing device 14.

As described above, the external force toward the upper side, which is added from the side of the external case 22 of the ink storing device 14 when the recording device 12 is lifted up, is not concentrated on the screw member 75 and is scattered to the reception section 63A of the depression 60 and the screw member 75 because the downward surface 63 of the depression 60 functions as the reception section 63A. Therefore, a possibility that the screw member 75 is bent due to the concentration of stress is reduced. Further, external force toward the upper side, which is added from the external case 22 of the ink storing device 14, is stably accepted in such a way that the downward surface 63 of the depression 60 in the main body case 31 functions as the reception section 63A. As a result, the attachment state of the external case 22 of the ink storing device 14 for the main body case 31 is excellently maintained.

According to the embodiment, it is possible to acquire the following advantages.

(1) When the user lifts up the recording device 12 using the ink storing device 14 as a handgrip, external force toward the upper side from the side of the ink storing device 14 is added to the main body case 31 of the recording device 12, and the external force is accepted by the reception section 63A of the main body case 31. Therefore, it is possible to avoid stress concentrating on the screw member 75 which functions as the attachment section when the ink storing device 14 is attached to the main body case 31. Accordingly, when the recording device 12 is lifted up using the ink storing device 14, which is attached to the side surface of the main body case 31, as a handgrip, it is possible to prevent the attachment state of the ink storing device 14 for the main body case 31 from being deteriorated.

(2) External force toward the upper side from the ink storing device 14 is accepted in such a way that the downward surface 63 of the depression 60 included in the reception section 63A comes into contact with the ink storing device 14 from the upper side. Accordingly, it is possible to easily avoid stress concentrating on the screw member 75 which is an example of the attachment section of the ink storing device 14 for the main body case 31 with a simple configuration.

(3) Since the depression 60, which is fitted to the protrusion 70 which protrudes from the external case 22 of the ink storing device 14 in the direction perpendicular to the vertical direction, is formed on the side surface of the main body case 31, it is possible to easily form the reception section 63A which stably accepts upward external force from the side of the ink storing device 14.

Meanwhile, the embodiment may be changed as shown below.

Figure 7:
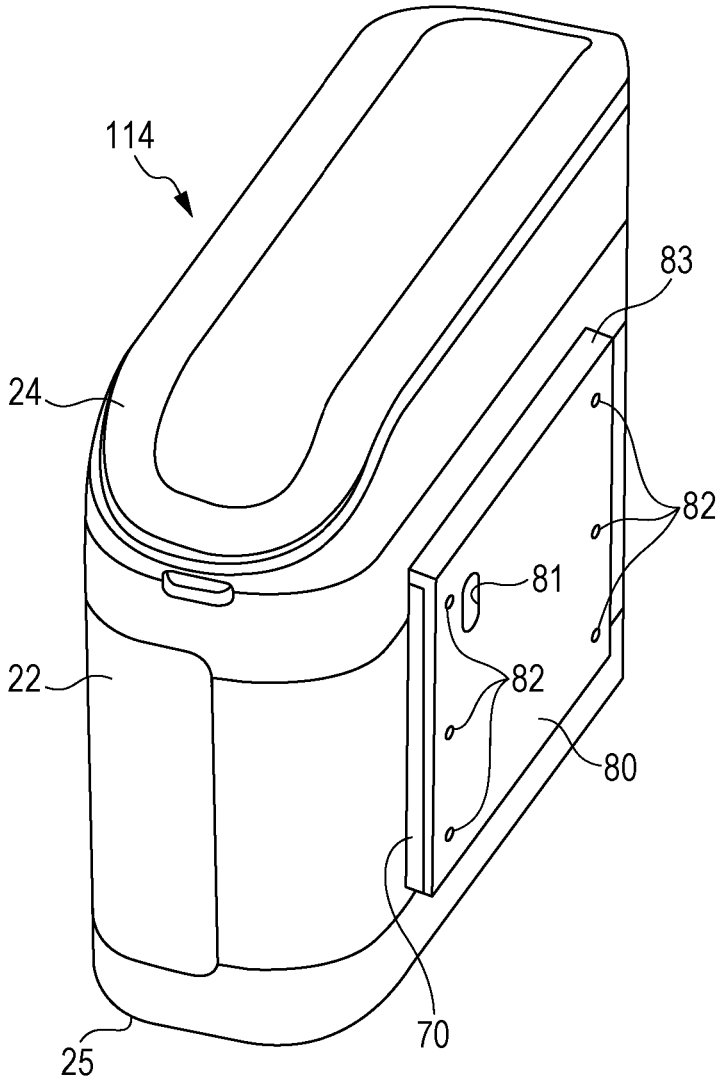
FIG. 7 is a perspective diagram illustrating an ink storing device according to a first modification example.
Figure 8:
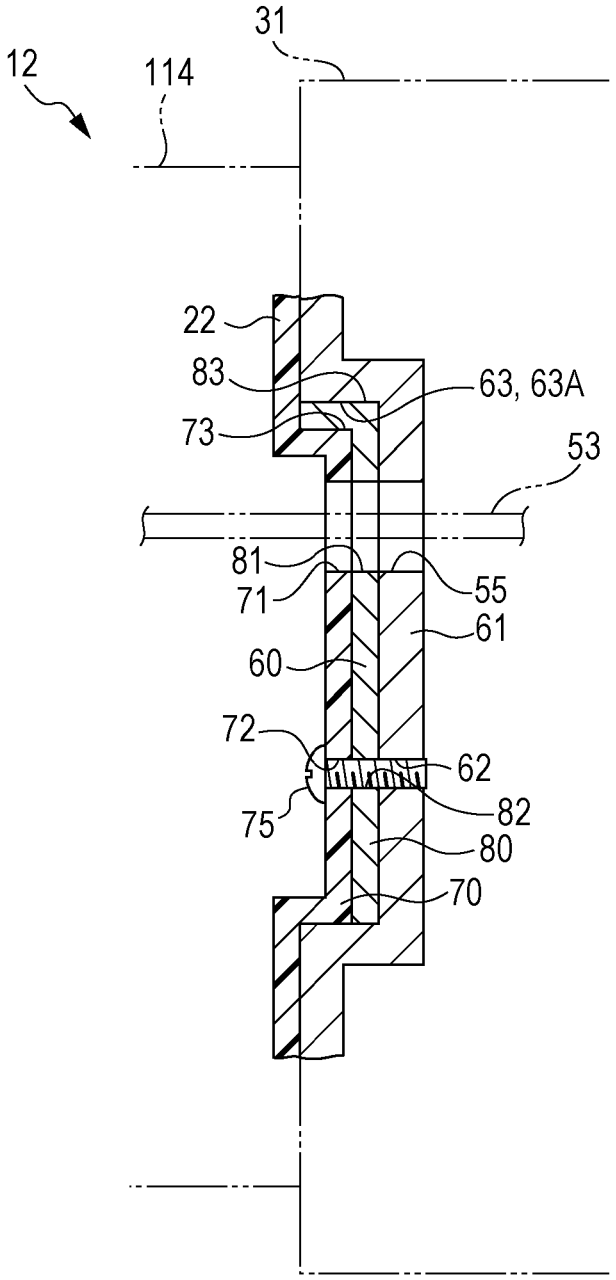
FIG. 8 is a cross-sectional diagram illustrating the attachment state of the main body case of the same ink storing device.

As in a first modification example illustrated in FIGS. 7 and 8, in an attachment structure for the main body case 31 of an ink storing device 114, a reinforcement member 80 may be interposed between the reception section 63A of the main body case 31 and the ink storing device 114.

That is, as shown in FIG. 7, the reinforcement member 80, which has an inverted L-shaped cross section, is coupled to the protrusion 70 which is formed to project toward the side of the main body case 31 from the side surface of the external case 22 of the ink storing device 114. In the external case 22 of the ink storing device 14, the reinforcement member 80 includes a plate formed of a metal material or the like, which has rigidity, compared to the component material (in this case, resin) of a portion which faces the downward surface 63 (reception section 63A) of the depression 60 on the side of the main body case 31.

In a position of the reinforcement member 80, where the connecting hole 55 on the side of the main body case 31 matches with the connecting hole 71 on the side of the ink storing device 114, a connecting hole 81, which cooperates with both the connecting holes 55 and 71 and causes the connection tubes 53 to be inserted, is formed to penetrate therethrough. In addition, in a plurality of spots (six spots in FIG. 7) of the reinforcement member 80, where the attachment holes 62 on the side of the main body case 31 match with the attachment holes 72 on the side of the ink storing device 114, attachment holes 82, which cooperate with both the attachment holes 62 and 72 and cause the screw member 75 to be screwed, are formed. That is, the attachment holes 82 in this case are also the screw holes which include female screws formed on the inner circumferential surface thereof. Further, in this case, the cross section of the reinforcement member 80, which faces upward when the reinforcement member 80 is attached to the main body case 31, forms an upward surface 83 which expands in the direction perpendicular to the vertical direction and faces the antigravity direction.

As shown in FIG. 8, the external case 22 of the ink storing device 114 according to the embodiment is attached to the side surface of the main body case 31 of the recording device 12 in a state in which the reinforcement member 80 is interposed between the protrusion 70 and the depression 60 on the side of the main body case 31. Further, in the attachment state, the connection tubes 53 are inserted into the continuous three connecting holes 55, 71, and 81, and the screw member 75 included in the attachment section is screwed into the three attachment holes 62, 72, and 82. Further, in the inner surface of the depression 60 on the side of the main body case 31, a portion, which faces the upward surface 83 of the reinforcement member 80 coupled to the protrusion 70 on the side of the ink storing device 114 in the vertical direction, forms the downward surface 63 which expands in the direction perpendicular to the vertical direction and faces the gravity direction.

Further, even in the first modification example which is configured as described above, when the user lifts up the recording device 12 (multi-function printer 11) using the external case 22 of the ink storing device 114 as a handgrip, upward external force added to the external case 22 is scattered to the screw member 75 and the downward surface 63 (reception section 63A) of the depression 60 and is then accepted. Therefore, a possibility that the screw member 75 is bent due to the concentration of stress is reduced.

Further, in the case of the first modification example, the protrusion 70 of the resin external case 22 is not directly pressed against the downward surface 63 (reception section 63A) of the depression 60 formed in the metal frame member 61, and the reinforcement member 80, which is formed of a plate material having rigidity, such as a metal material, and covers the protrusion 70, is pressed. Therefore, when the recording device 12 is lifted up, a possibility that the resin the external case 22 of the ink storing device 114 is worn or deformed is reduced.

Accordingly, according to the first modification example, the following advantages may be accomplished in addition to the advantages (1) to (3) in the embodiment.

(4) It is possible to strengthen the attachment state of the ink storing device 114 for the main body case 31 of the recording device 12 by interposing the reinforcement member 80.

Figure 9A:
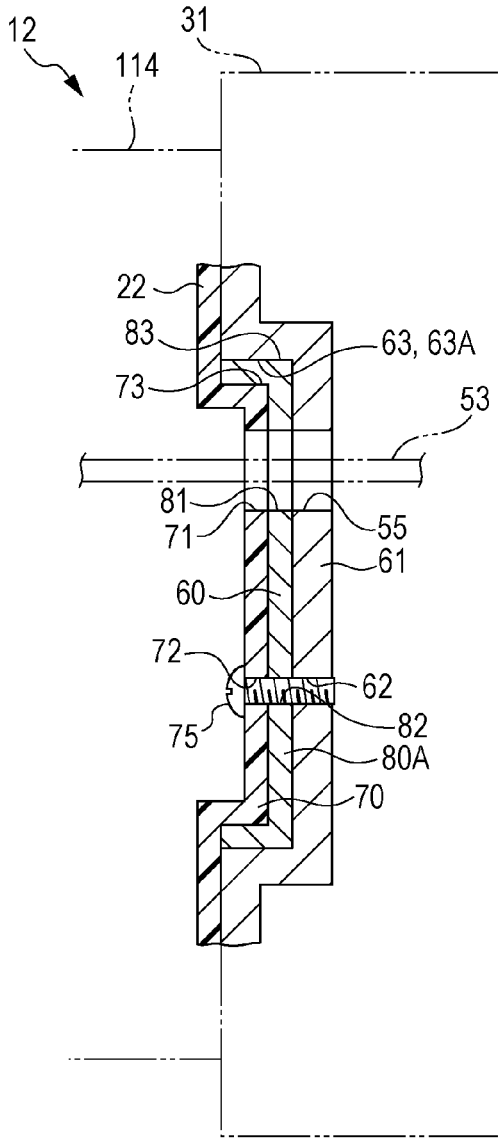
FIG. 9A is a cross-sectional diagram illustrating the attachment state of the main body case of an ink storing device according to a second modification example.

As in a second modification example illustrated in FIG. 9A, a reinforcement member 80A, which has a U-shaped cross section, may be coupled to the protrusion 70 of the external case 22 instead of the reinforcement member 80 which has the inverted L-shaped cross section. In this case, the weight of the ink storing body 21 stored in the external case 22 becomes large. Therefore, even when downward external force is added to the side of the main body case 31 from the side of the external case 22, a possibility that the downward cross-section of the resin protrusion 70 is worn or deformed is reduced.

Figure 9B:
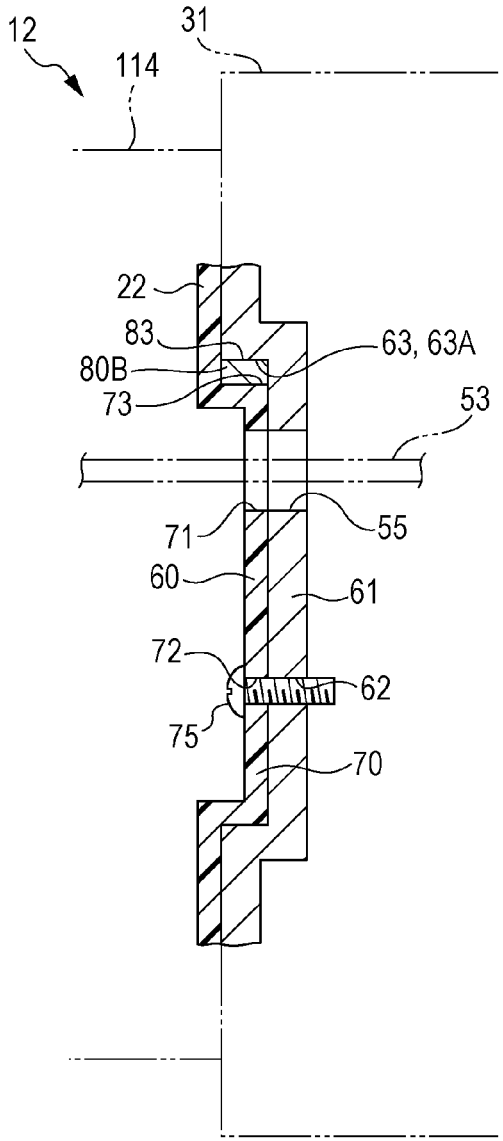
FIG. 9B is a cross-sectional diagram illustrating the attachment state of the main body case of an ink storing device according to a third modification example.

In addition, as in a third modification example illustrated in FIG. 9B, a reinforcement member 80B which has a horizontally long rectangular cross section may be interposed between the upward surface 73 of the protrusion 70 of the external case 22 and the downward surface 63 (reception section 63A) of the depression 60 on the side of the main body case 31. In this case, it is possible to acquire the advantage (4) of the first modification example in the same manner.

Figure 10A:
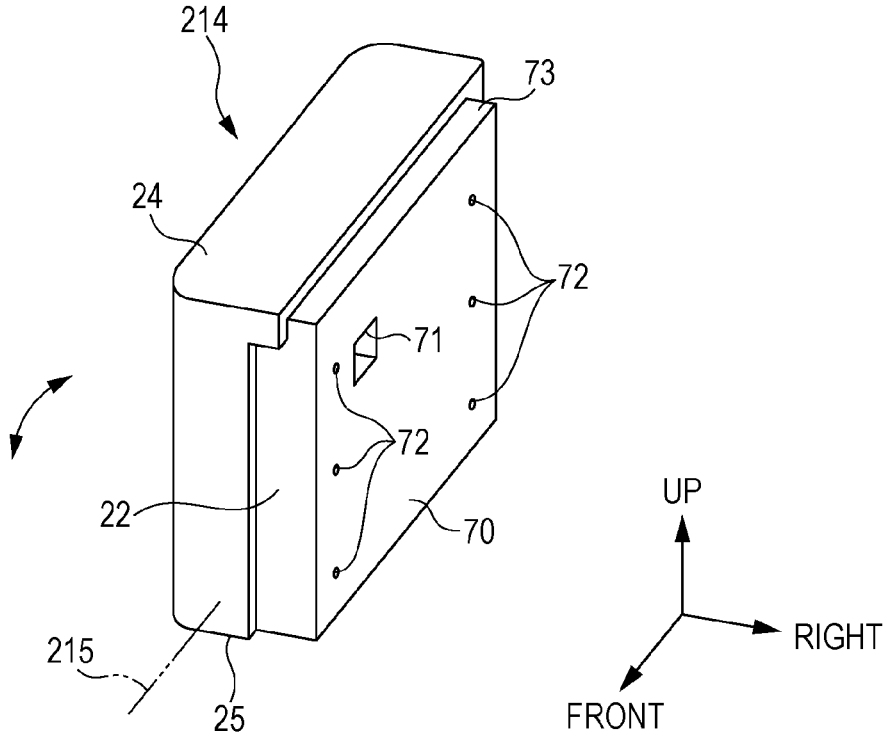
FIGS. 10A and 10B are perspective diagrams illustrating an ink storing device according to a fourth modification example.
Figure 10B:
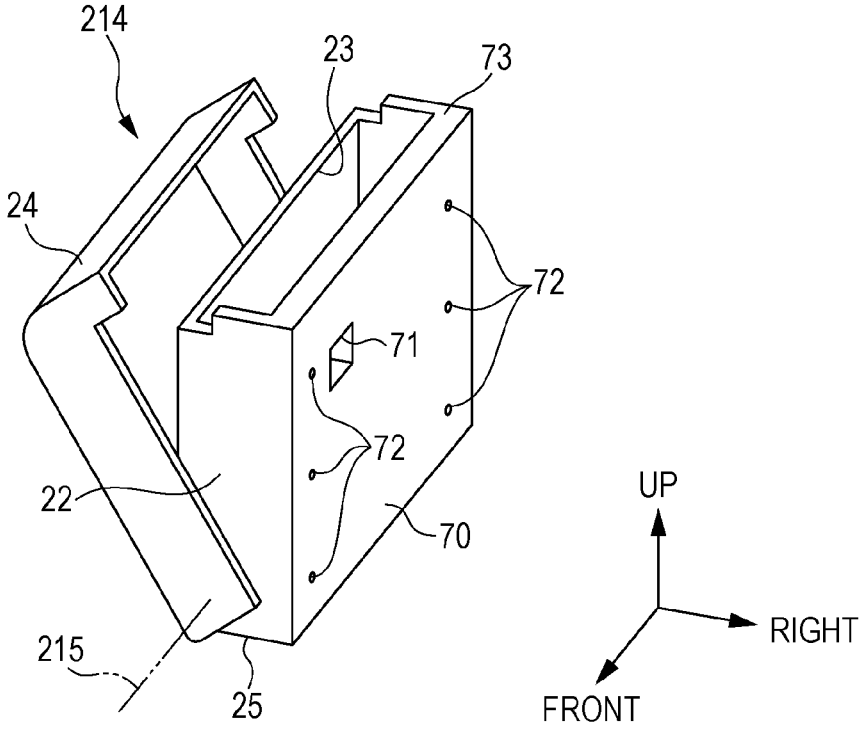

In addition, the form of an ink storing device 214 may be changed as in a fourth modification example illustrated in FIGS. 10A and 10B.

That is, the external case 22 of the ink storing device 214 according to the fourth modification example has a vertically-long bottomed rectangular box shape which as an upward opening 23, and includes a lid 24 which opens and closes the opening 23. The lid 24 rotationally moves against the external case 22 while a shaft line 215 which expands in the front and rear direction adjacent to the lower end of the external case 22 is used as the center of rotation, and thus the lid 24 performs an opening and closing operation between a closed state of FIG. 10A in which the opening 23 is covered and an open state of FIG. 10B in which the opening 23 is exposed.

Further, as shown in FIG. 10A, when the lid 24 is in the closed state, the opening 23 of the lid 24 is covered. Therefore, approximately one-third of the part on the right side which is the opposite side of the lid 24 in the horizontal direction is a protrusion 70 which protrudes to the right side, which is the side of the main body case 31, when the external case 22 is attached to the main body case 31. Further, in the protrusion 70, a connecting hole 71, which enables the connection tubes 53 to be inserted, and attachment holes 72, which are screw holes enabling the screw member 75 to be screwed, are formed to penetrate therethrough and to communicate with the inside and outside of the external case 22. In addition, in the protrusion 70, an upward cross-sectional portion which is not covered by the lid 24 is an upward surface 73 which expands in the direction perpendicular to the vertical direction.

Figure 11A:
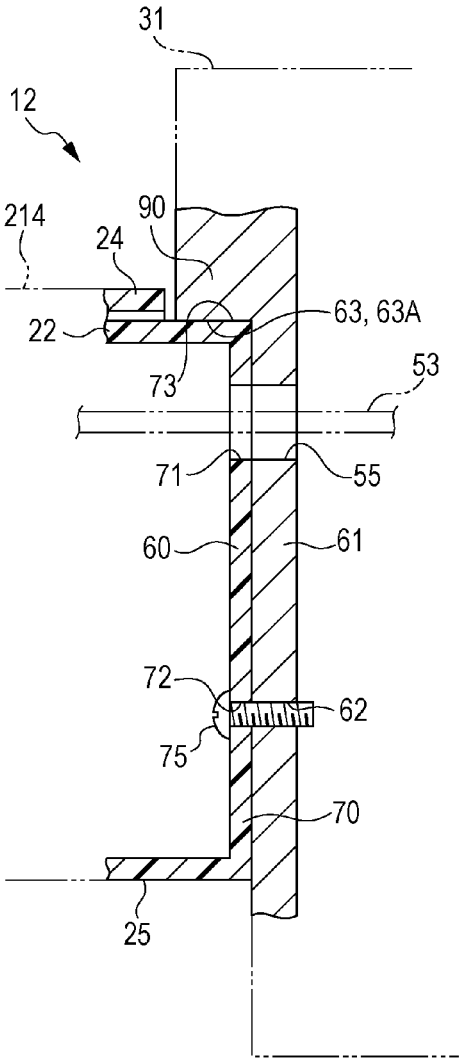
FIG. 11A is a cross-sectional diagram illustrating the attachment state of the main body case of the same ink storing device.

As shown in FIG. 11A, the main body case 31 of the recording device 12, which enables the ink storing device 214 to be attached, according to the fourth modification example includes an eave section 90, which is projected in the direction perpendicular to the vertical direction, on the side surface thereof. Further, the surface on the bottom side of the eave section 90 is the downward surface 63 which functions as the reception section 63A. In a state in which the upward surface 73 of the protrusion 70 comes into contact with the downward surface 63 and the surface of the protrusion 70 along the vertical direction comes into contact with the side surface of the main body case 31, the external case 22 is attached to the main body case 31. As above, even in a case of the recording device 12 in which it is difficult to form the depression 60 on the side surface of the main body case 31 and the recording device 12 which includes the eave section 90 on the side surface of the main body case 31, it is possible to attach the ink storing device 214 as in the fourth modification example.

Figure 11B:
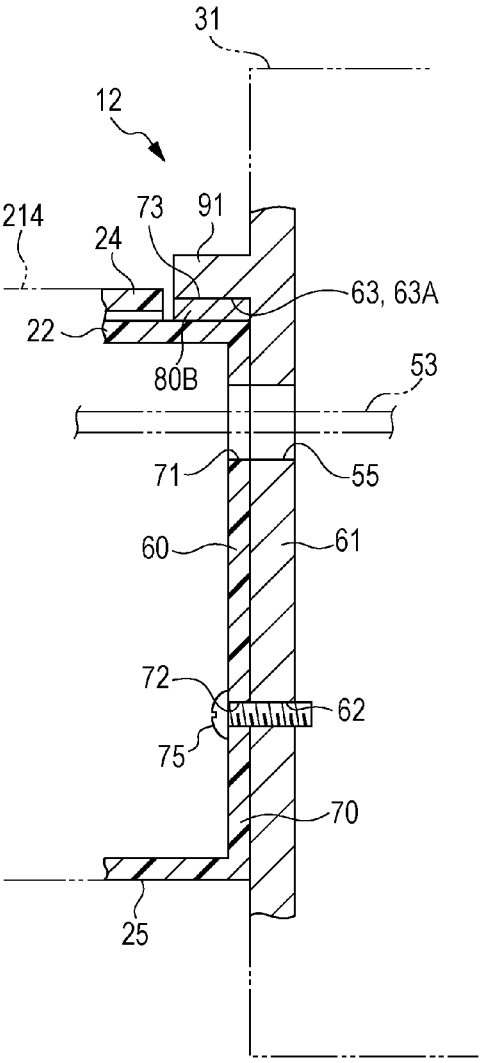
FIG. 11B is a cross-sectional diagram illustrating the attachment state of the main body case of the ink storing device according to the modification example.

Meanwhile, as shown in FIG. 11B, the eave section 91, which forms the downward surface 63 which functions as the reception section 63A, may be formed by a rectangular cross-sectional projection which is formed to project from the side surface of the main body case 31 in the direction perpendicular to the vertical direction. Even in this case, it is possible to attach the ink storing device 214 as in the fourth modification example.

Figure 12:
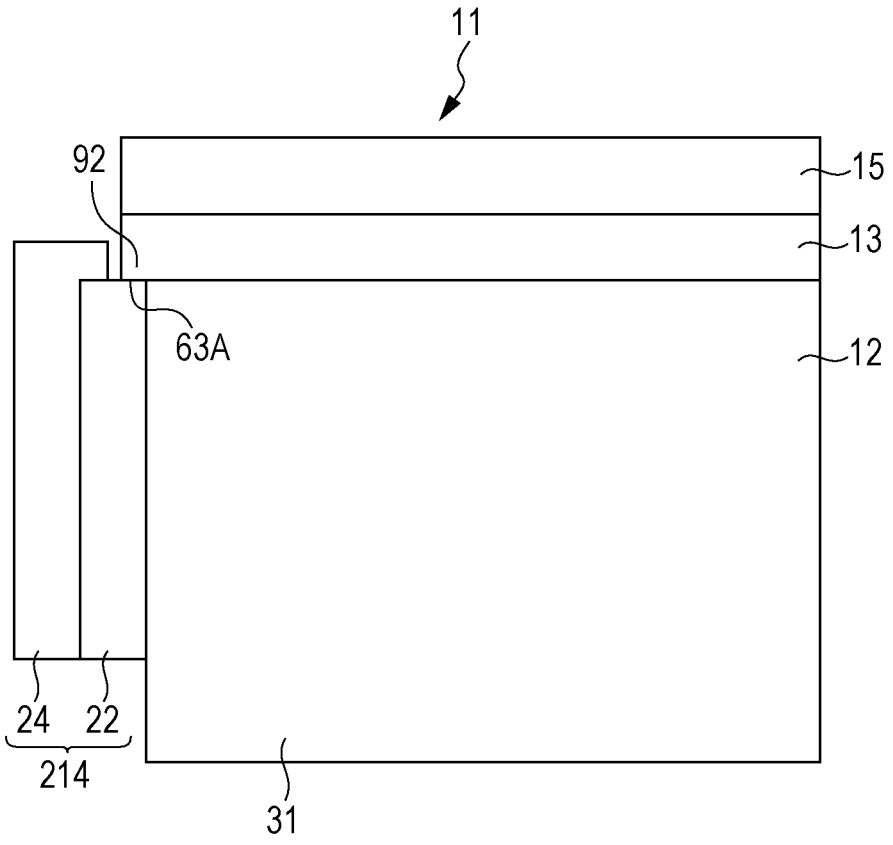
FIG. 12 is a schematic diagram illustrating a multi-function printer which includes a recording device according to a fifth modification example.

In addition, as in a fifth modification example illustrated in FIG. 12, when an eave section 92 is formed in such a way that the reading device 13, which is located on the upper side of the recording device 12 in the multi-function printer 11, is laterally projected rather than the upper end of the side surface of the recording device 12, that is, in the direction perpendicular to the vertical direction, it is possible to form the reception section 63A using the eave section 92. Meanwhile, even in this case, the ink storing device 214 according to the fourth modification example is attached as the ink storing device which is attached to the side surface of the main body case 31 of the recording device 12.

Figure 13:
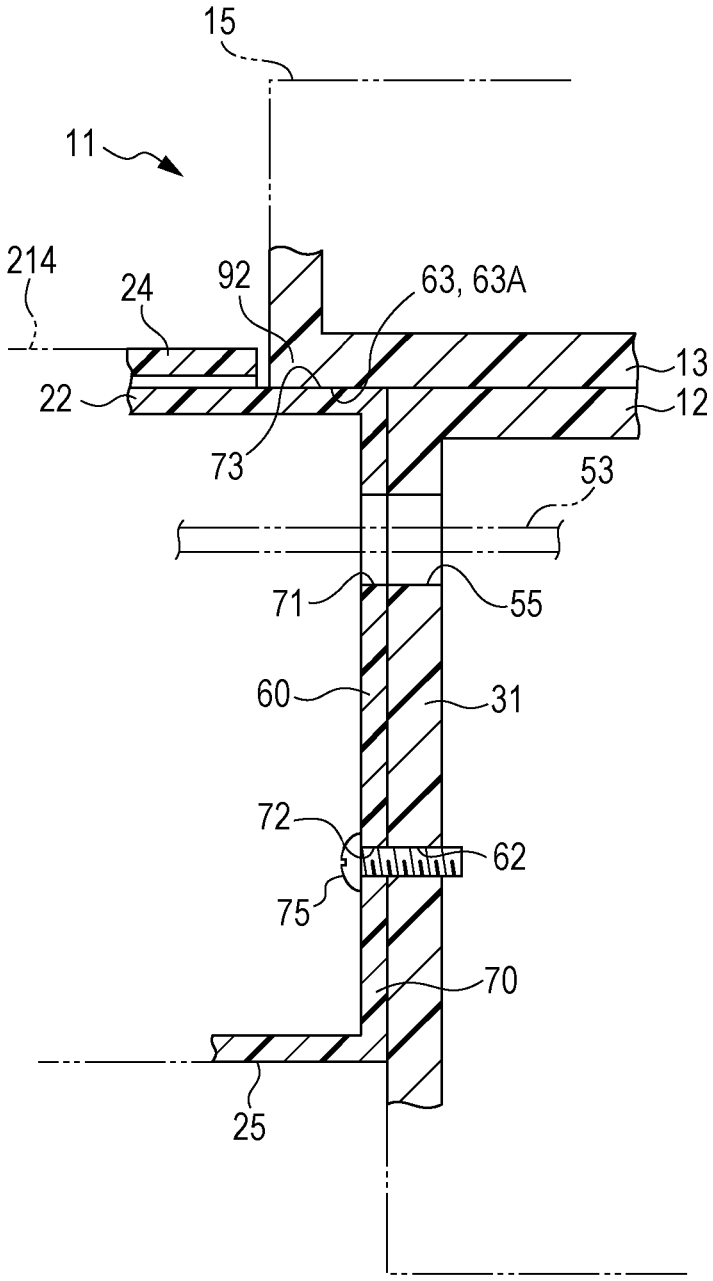
FIG. 13 is a cross-sectional diagram illustrating the attachment state of the main body case of an ink storing device in the recording device.

In this case, as shown in FIG. 13, the bottom side surface of the eave section 92, which is formed by the projected end of the reading device 13, is the downward surface 63 which functions as the reception section 63A. In a state in which the upward surface 73 of the protrusion 70 comes into contact with the downward surface 63 and the surface of the protrusion 70 along the vertical direction comes into contact with the side surface of the main body case 31, the external case 22 is attached to the main body case 31.

In the embodiment and each of the modification examples, the ink storing devices 14, 114, and 214 are arranged on one side of the recording device 12 in the horizontal direction. However, the ink storing devices 14, 114, and 214 may be arranged on one side of the recording device 12 in the front and rear direction.

Figure 14:
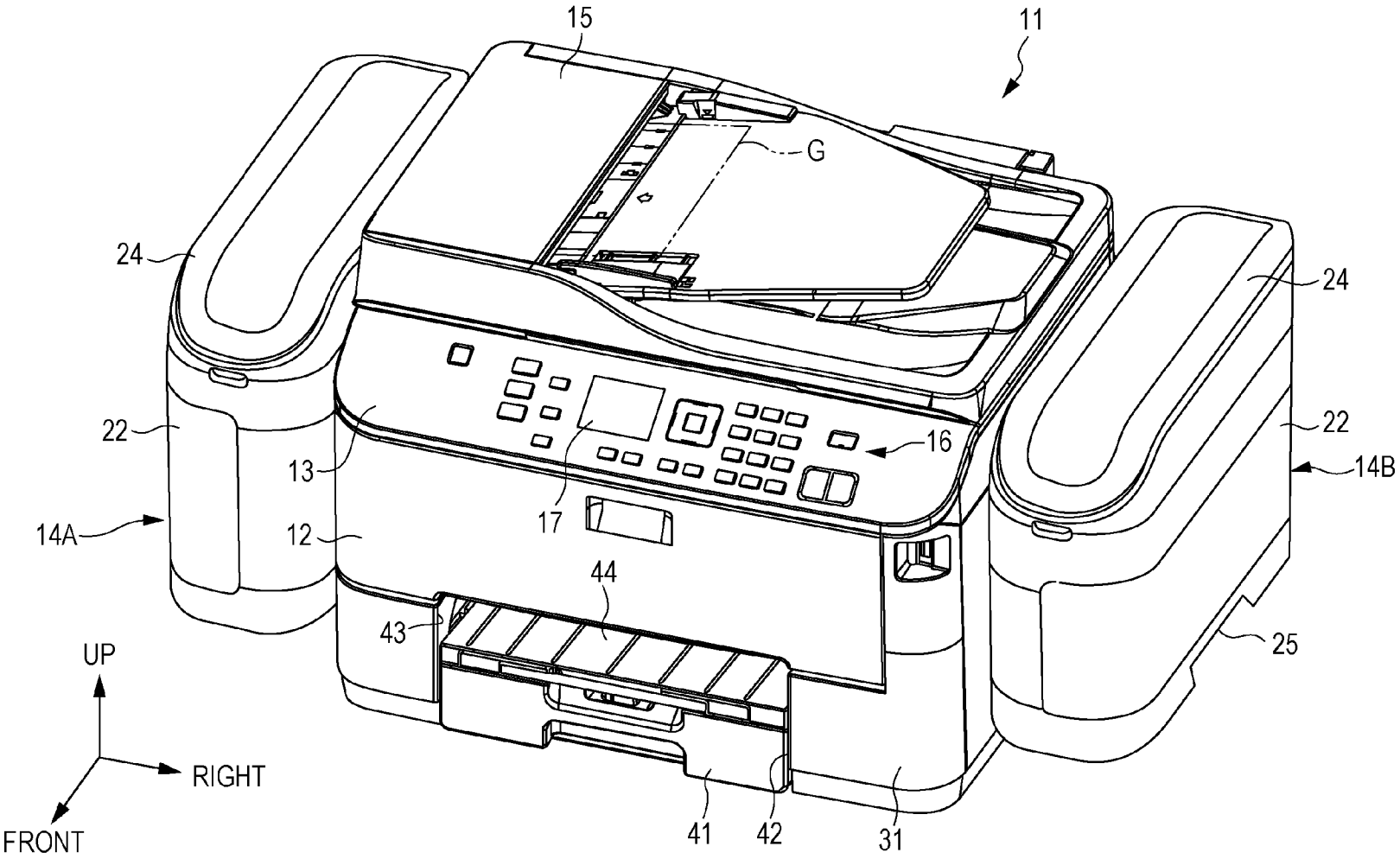
FIG. 14 is a perspective diagram illustrating the appearance of a multi-function printer which includes a recording device according to a sixth modification example.
Figure 15:
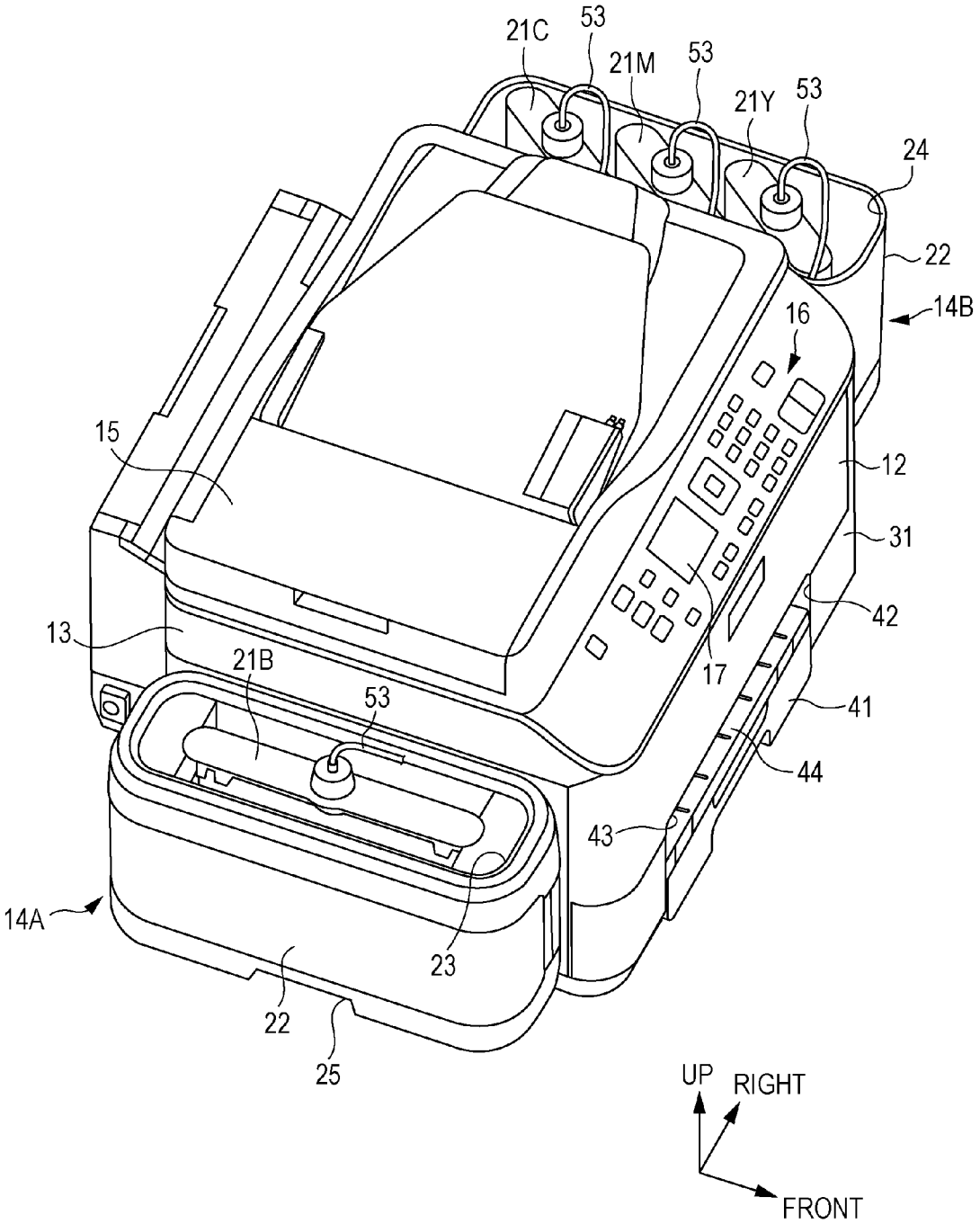
FIG. 15 is a perspective diagram illustrating a state in which the lid of an ink storing device in the recording device is removed.

In addition, as in a sixth modification example illustrated in FIGS. 14 and 15, ink storing devices 14A and 14B may be arranged on both sides of the recording device 12 in the horizontal direction. In this case, as shown in FIG. 15, a black ink storing body 21B may be stored in the ink storing device 14A which is arranged on one side of the recording device 12 in the horizontal direction, and respective cyan, magenta, and yellow ink storing bodies 21C, 21M, and 21Y may be stored in the ink storing device 14B which is arranged on the other side. In addition, another colored ink storing body, for example, white, light cyan or light magenta may be stored in the ink storing device 14B. In addition, two ink storing bodies of the black, cyan, magenta, and yellow ink storing bodies may be stored in one side ink storing device 14A, and the other ink storing bodies may be stored in the other side ink storing device 14B.

Figure 16A:
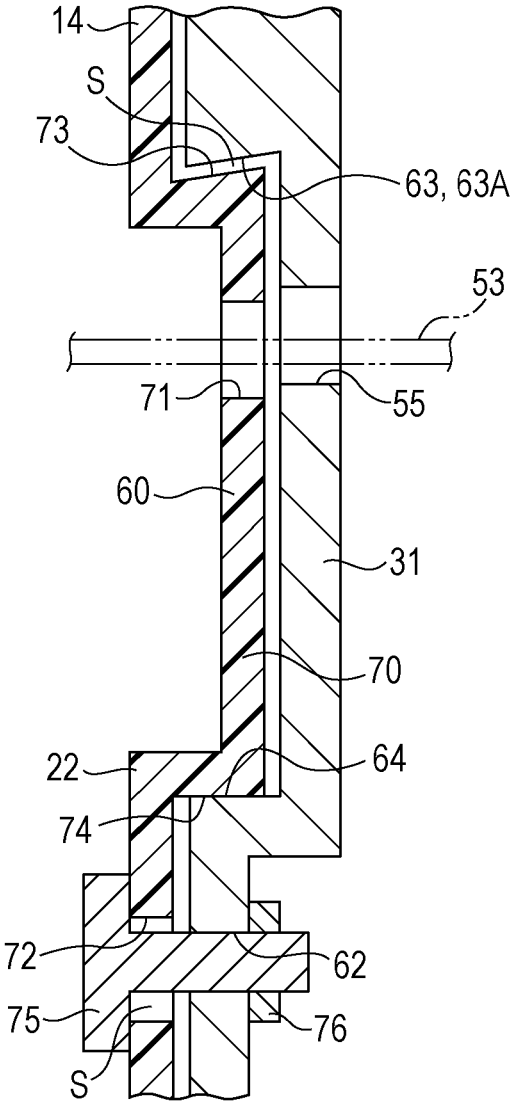
FIGS. 16A and 16B are cross-sectional diagrams illustrating the attachment state of the main body case of the ink storing device according to a seventh modification example.
Figure 16B:
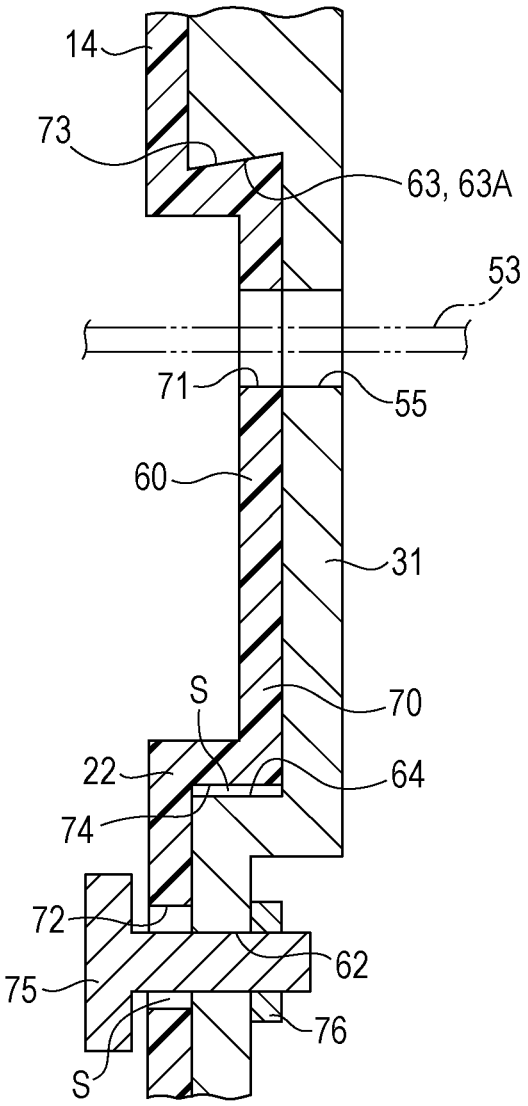

In addition, as in a seventh modification example illustrated in FIGS. 16A and 16B, the external case 22 of the ink storing device 14 may be attached to the outer side surface of the main body case 31 of the recording device 12 in a displaceable state. In this case, as shown in FIG. 16A, a gap S, which is provided to permit the displacement of the external case 22 when the recording device 12 is lifted up, is formed between the downward surface 63, which forms the reception section 63A of the depression 60 on the side of the main body case 31, and the upward surface 73 which is included in the protrusion 70 of the external case 22 of the ink storing device 14.

In addition, in the seventh modification example, the internal diameters of the attachment holes 72, which are formed to penetrate through the external case 22 of the ink storing device 14, are formed to be greater than the external diameter of the screw member 75, and a gap S, which is greater than the gap S between the downward surface 63 of the depression 60 and the upward surface 73 of the protrusion 70, is formed between the inner circumferential surfaces of the attachment holes 72 and the external circumferential surface of the screw member 75. Meanwhile, a nut 76 is screwed to the tip section of the screw member 75 from the inside of the main body case 31.

Further, in the seventh modification example, the downward surface 63 (reception section 63A) of the depression 60 is a surface-shaped inclined surface which inclines from a side separated from the main body case 31 toward a side approaching the main body case 31 in the direction perpendicular to the vertical direction. Further, in the same manner, the upward surface 73 of the protrusion 70 which faces the downward surface 63 in the vertical direction is also a surface-shaped inclined surface which inclines from the side separated from the main body case 31 toward the side approaching the main body case 31 in the direction perpendicular to the vertical direction. Meanwhile, the downward cross section 74, which faces the side of the gravity direction in the protrusion 70, and an upward inner surface 64, which faces the side of the antigravity direction in the depression 60, are formed along the horizontal direction perpendicular to the vertical direction.

Therefore, in an usual state (a state before being lifted up) shown in FIG. 16A, the ink storing device 14 is attached to the main body case 31 in a state in which the downward cross section 74 of the protrusion 70 of the external case 22 comes into contact with the upward inner surface 64 of the depression 60 on the side of the main body case 31 from above and a gap S is provided between the upward surface 73 of the protrusion 70 and the downward surface 63 of the depression 60. Further, if the user lifts up the recording device 12 using the ink storing device 14 as a handgrip in such a state, the protrusion 70 on the side of the ink storing device 14 is displaced upward in the depression 60 on the side of the main body case 31, and the upward surface 73 of the protrusion 70, which has an inclined surface shape, comes into contact with the downward surface 63 of the depression 60, which has the same inclined surface, from below.

If both the upward surface 73 of the protrusion 70 and the downward surface 63 of the depression 60 include a surface-shaped inclined surface which rises toward a side approaching the main body case 31, and thus the ink storing device 14 is displaced upward while the upward surface 73 of the protrusion 70 slides on the downward surface 63 of the depression 60. That is, with regard to the downward surface 63 of the depression 60, which forms an inclined surface rising by the depth side on the inner surface, the upward surface 73 of the protrusion 70, which has the same inclined surface, slides thereon to be encroached on a wedge shape. Therefore, the ink storing device 14 is displaced to press the outer side surface of the main body case 31, as shown in FIG. 16B. Accordingly, according to a seventh modification example, when the user lifts up the recording device 12 using the ink storing device 14 as a handgrip, the ink storing device 14 is displaced on the side of the main body case 31 while the upward surface 73 slides on the downward surface 63 of the reception section 63A of the main body case 31 in the oblique upper direction, and thus it is possible to excellently maintain the attachment state for the main body case 31.

While the depression 60, which includes the downward surface 63 functioning as the reception section 63A, is formed on the side surface of the external case 22 of the ink storing device 14, 114, or 214, the protrusion 70, which includes the upward surface 73 capable of coming into contact with the downward surface 63 in the depression 60 may be formed to project from the outer side surface of the main body case 31.

The depth of the depression 60, which includes the downward surface 63 functioning as the reception section 63A on the inner surface thereof, may be a depth corresponding to the thickness of the reinforcement member 80 in a case of, for example, the second modification example shown in FIG. 8.

The attachment section, in which the external case 22 of the ink storing device 14, 114, or 214 is attached to the outer side surface of the main body case 31, may be, for example, a rivet or an attachment bane, an adhesive, or the like in addition to the screw member 75.

In the embodiment, the recording device 12 is implemented as a serial printer. However, the recording device 12 may be a line printer or a page printer.

In the embodiment, the recording device 12 may be a liquid ejecting device which ejects or discharges another liquid other than ink. Meanwhile, the state of liquid, which is discharged from the liquid ejecting device with a small quantity of droplets, includes the state of liquid which leaves a trail in the form of particles, tears, or lines. In addition, here, the liquid may be a material which can be ejected from the liquid ejecting device. For example, liquid may be a material in a liquid state, and includes a fluid state body which has high or low viscosity, sol, gel water, and the other fluid state bodies such as an inorganic solvent, an organic solvent, a solution, a liquid resin, and a liquid metal (melt metal). In addition, in addition to liquid as one state of a material, the liquid includes a material in which the particles of a functional material formed of solid bodies, such as pigments or metal particles, are melt, scattered, or mixed by a solvent. Ink, liquid crystal, or the like as described in the embodiment may be exemplified as a typical example of liquid. Here, ink includes general water-based ink, oil-based ink, and various liquid compositions, such as gel ink and hot melt ink.

As a detailed example of the liquid ejecting device, there is a liquid ejecting device that ejects liquid which includes a scattered or melt material, such as an electrode material or a color material, used when, for example, a liquid crystal display, an Electro-luminescence (EL) display, a surface emission display, a color filter or the like is manufactured. In addition, a liquid ejecting device that ejects the organic matter of a living body, which is used when a biochip is manufactured, a liquid ejecting device that ejects liquid which is a sample used as a precise pipette, a printing apparatus, a microdispenser, or the like may be provided. Further, a liquid ejecting device that ejects lubricant oil to a precision machine, such as a watch or a camera, with pinpoint precision, or a liquid ejecting device that ejects transparent resin liquid, such as ultraviolet curing resin, to a substrate in order to form a minute semispherical lens (optical lens) or the like which is used for an optical communication element or the like may be provided. In addition, a liquid ejecting device which ejects an etchant, such as acid or alkali, for etching a substrate or the like may be provided.

The entire disclosure of Japanese Patent Application No. 2013-261042, filed Dec. 18, 2013 is expressly incorporated by reference herein.

What is claimed is:

1. A recording device comprising:

a recording head that ejects liquid to a medium;

a device main body that is arranged with the recording head inside; and a liquid storing device that is configured to store the liquid to be supplied to the recording head and is attached to an outer side surface of the device main body through an attachment section, wherein the device main body includes a reception section which can accept external force when upward external force is added from the liquid storing device, wherein one of the outer side surface of the device main body and the liquid storing device includes a protrusion and the other of the outer side surface of the device main body and the liquid storing device includes a depression, wherein the protrusion fits in the depression such that a portion of the protrusion presses against a portion of the depression when accepting the upward external force.

2. The recording device according to claim 1, wherein the reception section includes a downward surface which expands in a direction perpendicular to a vertical direction and faces a gravity direction.

3. The recording device according to claim 2, wherein the downward surface has a surface shape which inclines toward a side approaching the device main body from a side separated from the device main body in the direction perpendicular to the vertical direction, and wherein the liquid storing device is attached to the outer side surface of the device main body in a displaceable state, and is configured to include an upward surface which can slide on the downward surface.

4. The recording device according to claim 1, wherein a reinforcement member, which comes into contact with the reception section with rigidity compared to a portion of the liquid storing device which faces the reception section, is interposed between the reception section of the device main body and the liquid storing device.

5. The recording device according to claim 1, wherein the reception section includes any of a protrusion which has a shape protruding in the direction perpendicular to the vertical direction, a depression which has a shape fitting to the protrusion, and an eave section which has a shape projecting in the direction perpendicular to the vertical direction.

6. A multi-function printer comprising:

a recording device that performs a recording operation by ejecting liquid; and a reading device that reads information recorded on a manuscript, wherein the recording device includes:

a recording head that ejects liquid to a medium;

a device main body that is arranged with the recording head inside; and a liquid storing device that is configured to store the liquid to be supplied to the recording head and is attached to an outer side surface of the device main body through an attachment section, wherein the device main body includes a reception section which can accept external force when upward external force is added from the liquid storing device, wherein the reading device is arranged in an upper portion of the device main body of the recording device, and wherein one of an outer side surface of the device main body and the liquid storing device includes a protrusion and the other of the outer side surface of the device main body and the liquid storing device includes a depression, wherein the protrusion fits in the depression such that a portion of the protrusion presses against a portion of the depression when accepting the upward external force.

7. A multi-function printer comprising:

a recording device that performs a recording operation by ejecting liquid, wherein the recording device includes:

a recording head that ejects liquid to a medium;

a device main body that is arranged with the recording head inside; and a liquid storing device that is configured to store the liquid to be supplied to the recording head and is attached to an outer side surface of the device main body through an attachment section;

a reading device that reads information recorded on a manuscript, wherein the reading device is arranged in an upper portion of the device main body of the recording device, and a portion of the reading device has a protruding portion which protrudes from the device main body in a direction intersecting a vertical direction; and a reception section which can accept an external force when an upward external force is added from the liquid storing device, and has a depression which is formed between the outer side surface of the device main body and an outer side surface of the protruding portion of the reading device, wherein the liquid storing device includes a protrusion, wherein the protrusion fits in the depression such that a portion of the protrusion presses against a portion of the depression when accepting the upward external force.

* * * * *